US006325587B1

(12) United States Patent
Wysocki et al.

(10) Patent No.: US 6,325,587 B1
(45) Date of Patent: Dec. 4, 2001

(54) SEGREGATED WASTE COLLECTION SYSTEM

(75) Inventors: Edward H. Wysocki, Kentwood, MI (US); Jimmy O. Bayne, Anderson, SC (US)

(73) Assignee: Cascade Engineerig, Inc., Grand Rapids, MI (US)

( * ) Notice: Subject to any disclaimer, the term of this patent is extended or adjusted under 35 U.S.C. 154(b) by 0 days.

(21) Appl. No.: 09/451,648

(22) Filed: Nov. 30, 1999

Related U.S. Application Data

(60) Provisional application No. 60/110,362, filed on Nov. 30, 1998.

(51) Int. Cl.[7] ..... B65F 3/04
(52) U.S. Cl. ..... 414/408; 220/909
(58) Field of Search ..... 414/406, 408; 220/909

(56) References Cited

U.S. PATENT DOCUMENTS

| | | | | |
|---|---|---|---|---|
| 5,035,563 | | 7/1991 | Mezey . | |
| 5,163,805 | | 11/1992 | Mezey . | |
| 5,205,698 | | 4/1993 | Mezey . | |
| 5,303,841 | | 4/1994 | Mezey . | |
| 5,458,452 | * | 10/1995 | Pellegrini | 414/406 |
| 5,490,606 | * | 2/1996 | Lombardo | 414/408 |
| 5,599,071 | * | 2/1997 | Kann et al. | 414/408 |
| 5,607,277 | * | 3/1997 | Zopf | 414/408 |
| 5,762,462 | * | 6/1998 | Bayne | 414/408 |
| 5,833,428 | * | 11/1998 | Szinte | 414/408 |
| 5,919,026 | * | 7/1999 | Appleton | 414/408 |
| 5,938,394 | * | 8/1999 | Christenson | 414/408 |
| 6,019,242 | * | 2/2000 | Wysocki et al. | 220/909 |
| 6,050,442 | * | 4/2000 | Wysocki | 220/909 |

FOREIGN PATENT DOCUMENTS

| | | | |
|---|---|---|---|
| DE 37 03 557 | | | |
| AI | | 8/1988 | (DE) . |
| 354256 | * | 2/1990 | (EP) . |
| 405428 | * | 1/1991 | (EP) . |
| 1388358 | * | 4/1988 | (SU) . |
| 9100231 | * | 1/1991 | (WO) . |
| 9407774 | * | 4/1994 | (WO) . |

* cited by examiner

*Primary Examiner*—James W. Keenan
(74) *Attorney, Agent, or Firm*—Radar, Fishman, Grauer & McGarry, An Office of Rader, Fishman & Grauer PLLC

(57) ABSTRACT

A segregated waste collection system for collecting segregated waste from a distant location and moving the collected segregated waste to a centralized collection station, while maintaining the segregated state of the waste. The segregated waste collection system comprises a waste container, a transfer container, and a collection vehicle, each of which has corresponding compartments for storing the segregated waste. The waste from the waste container is transferred to the transfer container and is then transferred to the collection vehicle. A deflector on the transfer container aligned with the transfer container divider and operable between a fill position and a dump position. In the fill position, the divider deflects the waste container contents from the waste compartments into the corresponding transfer compartments. In the dump position, the deflector deflects the contents from the transfer compartments into the corresponding storage compartments.

23 Claims, 6 Drawing Sheets

SEGREGATED WASTE COLLECTION SYSTEM

This application claims priority of U.S. provisional 60/110,362 filed Nov. 30, 1998, now abandoned.

BACKGROUND OF THE INVENTION

1. Field of the Invention

The invention relates to a segregated waste collection system and, more specifically, to a segregated waste collection system having a divided waste cart, defining separate compartments for holding segregated waste, in combination with a divided collection container having corresponding separate compartments for receiving the segregated waste from the divided cart compartments.

2. Description of the Related Art

Segregated waste collection systems are typically used when both recyclable and non-recyclable waste are simultaneously collected. In segregated waste collection systems, it is common to provide a user with a divided waste container, having a dividing wall defining one compartment for recyclable waste and another compartment for non-recyclable waste. A cover for each of the compartments is hingedly mounted to the divider wall in the container and performs the dual function of covering the associated compartment and deflecting the contents of the compartment when the cart is dumped. The waste cart is typically lifted with a mechanical device and inverted so that the compartments within the waste cart overlie corresponding compartments in a waste collection vehicle. As the cart is inverted, the covers open in response to gravity and serve to deflect the contents dumping from the compartments of the cart into the corresponding compartments of the waste vehicle. Examples of such a waste collection system are illustrated in U.S. Pat. No. 5,035,563, issued Jul. 30, 1991, U.S. Pat. No. 5,163,805, issued Nov. 17, 1992, U.S. Pat. No. 5,205,698, issued Apr. 27, 1993, and U.S. Pat. No. 5,303,841, issued Apr. 19, 1994.

One disadvantage of the prior art segregated waste collection system is there is frequently cross contamination of the contents of one cart compartment into cross compartments in the waste vehicle. Another disadvantage is that the cart construction and use becomes increasingly more complex and difficult, especially as the number of compartments increase beyond two, as compared to a traditional cart with a single cover for all the compartments.

SUMMARY OF THE INVENTION

The invention relates to a segregated waste collection system for collecting segregated waste from a distant location and moving the collected segregated waste to a centralized collection station, while maintaining the segregated state of the waste. The segregated waste collection system comprises a waste container, a transfer container, and a collection vehicle. The waste from the waste container is transferred to the transfer container and is then transferred to the collection vehicle.

The waste container is located at the distant location and comprises a bottom wall from which extends a peripheral wall to define a waste-receiving chamber. A divider is disposed within the waste-receiving chamber to divide the waste-receiving chamber into two waste compartments. Each of the waste compartments is capable of receiving different types of waste to thereby segregate the waste. The transfer container comprises a base from which extends a peripheral wall to define a transfer chamber and a divider disposed within the transfer chamber to divide the transfer chamber into two transfer compartments. Each of the transfer compartments corresponds to a different one of the two waste compartments in the waste container. The collection vehicle comprises a storage container and a divider disposed within the storage container to divide the storage container into two storage compartments. Each of the storage compartments corresponds to one of the transfer compartments. A collection vehicle additionally includes a loading mechanism that carries the transfer container and is operable between a transfer position, in which the container is positioned to receive the contents of the waste container, and a dumping position, in which the transfer container is positioned to dump its contents into the storage container.

The segregated waste collection system further includes a deflector on the transfer container aligned with the transfer container divider and operable between a fill position and a dump position. In the fill position, the divider deflects the waste container contents from the waste compartments into the corresponding transfer compartments when the waste container is at least partially inverted over the transfer container when the transfer container is the transfer position. In the dump position, the deflector deflects the contents from the transfer compartments into the corresponding storage compartments when the transfer container is in the dumping position to thereby maintain the segregated status of the waste from the waste container to the storage container.

Preferably, the deflector comprises a pair of opposing vanes. Each vane can have an inner edge and an outer edge, with the inner edges extended along the transfer container divider and the outer edges being spaced above the transfer container divider. The outer edges can be spaced with respect to each other to define a gap that receives at least one of the container divider when the transfer container is in the transfer position and the storage container divider when the transfer container is in the dumping position. The vanes can be made from a flexible material and the gap can be sized so that the vanes are flexed slightly outward when at least one of the at least one container divider and the storage container divider are received within the gap to thereby form a substantially continuous barrier between the transfer container divider and the one of the at least one container divider and the storage container divider.

The vanes are preferably pivotally mounted at their inner edges to the transfer container for pivotal movement between a fill position in which the outer edges substantially abut each other and a dump position in which the outer edges are spaced from each other and each outer edge partially overlies a different transfer compartment. The vanes are in the fill position when the transfer container is in the transfer position and the vanes are in the dump position when the transfer container is in the dumping position. A pair of hinges can be provided to mount each of the vane inner edges to the divider of the transfer container to thereby pivotally mount the vanes to the transfer container. Preferably, a pair of actuators between the transfer container and one of the vanes are adapted to selectively pivot the vanes between the fill and dump positions.

In another aspect, the invention relates to a segregated waste collection system for collecting segregated waste from a distant location and moving the collected segregated waste to a centralized collection station while maintaining the segregated state of the waste. The segregated waste collection system comprises a transfer container with a deflector and a collection vehicle. The transfer container comprises a base from which extends a peripheral wall to define a transfer chamber. A divider is disposed within the transfer chamber to divide the transfer chamber into two transfer compartments. The collection vehicle comprises a storage container in which a divider is disposed to divide the storage container into two storage compartments. Each of the storage compartments corresponds to a different one of the two transfer compartments. The collection vehicle further includes a loading mechanism carrying the transfer container and operable between a receiving position, in which the transfer container is positioned to receive waste material, and a dumping position, in which the transfer container is positioned to dump its contents into the storage container. The deflector comprises a pair of opposing vanes. Each of the vanes has an inner edge and an outer edge. The inner edges of the vanes extend along the transfer container divider. The outer edges of the vanes are spaced above the transfer container divider. The deflector deflects the waste compartment contents into the corresponding transfer compartments to aid in segregating the waste. The divider also deflects the waste from the transfer compartments into the corresponding storage compartments when the transfer container is in the dumping position to thereby maintain the segregated status of the waste from the transfer container to the storage container.

In yet another aspect, the invention relates to a transfer container for a segregated waste collection system. The transfer container comprises a base from which extends a peripheral wall to define a transfer chamber. A divider is disposed within the transfer chamber to divide the transfer chamber into two transfer compartments. A transfer container further comprises a deflector aligned with the transfer container divider. The deflector is movable between a fill position and a dump position. In the fill position, the deflector aids in deflecting segregated contents into corresponding transfer compartments. In the dump position, the deflector aids in deflecting the contents of the transfer compartments into corresponding compartments in a collection vehicle.

The invention also relates to a method of collecting segregated waste in waste-receiving chambers in a divided container at a waste-generation site and then transferring the segregated waste to a collection vehicle having two storage compartments. The segregated waste is first dumped into separate transfer chambers in a transfer container and then dumped into storage compartments in the collection vehicle. The waste is deflected from the waste-receiving chambers into the transfer chambers as the waste is dumped into the transfer container, and the waste is deflected from the transfer chambers into the storage compartments as the waste is dumped from the transfer container into the collection vehicle.

BRIEF DESCRIPTION OF THE DRAWINGS

The invention will now be described with reference to the drawings in which.

DETAILED DESCRIPTION OF THE PREFERRED EMBODIMENTS

Figure 1:
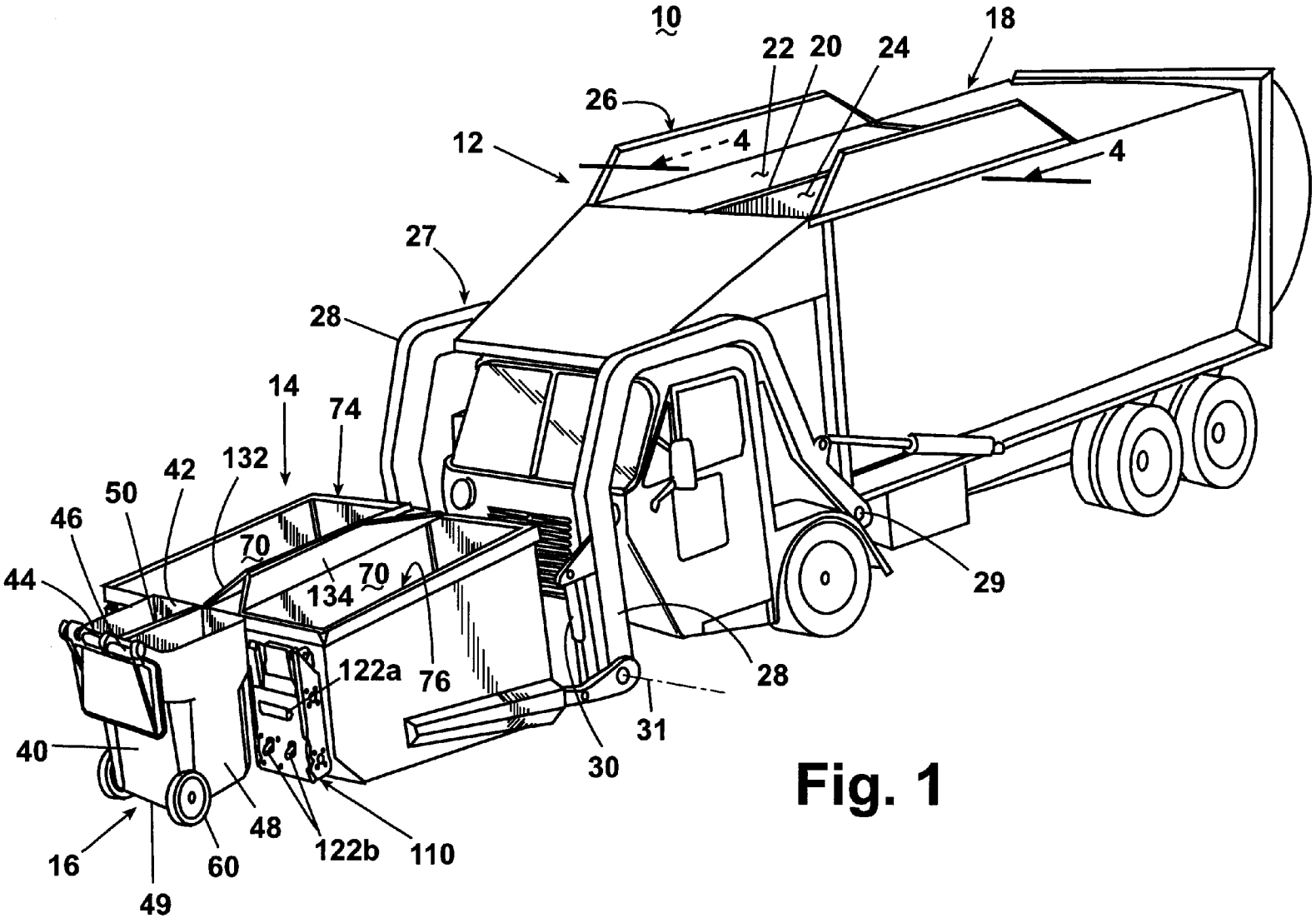
FIG. 1 is a perspective view of a segregated waste collection system, including a waste collection vehicle, an intermediate size container, and a divided cart, according to the invention.

The segregated waste collection system 10 according to the invention comprises a waste collection vehicle 12, an intermediate size container 14 and a divided cart 16. In typical operation, the divided cart 16 is filled with waste and is emptied into the intermediate size container 14, which can hold the waste from many divided carts. The contents of the intermediate size container are ultimately emptied into the waste collection vehicle 12.

The waste collection vehicle 12 comprises a waste storage container 18 having a divider wall 20, separating the waste storage container 18 into two compartments 22, 24. One of the compartments is used to store recyclable materials and the other compartment preferably stores non-recyclable materials. A hopper 26, on the top of the waste storage container 18, provides access to the first and second compartments 22 and 24 of the waste storage container 18.

The waste collection vehicle also comprises a hydraulic lift 27 for lifting the intermediate size container 14 from a fill position (FIG. 1) to an dumping position (FIG. 7), in which the contents of the intermediate size container are emptied into the waste collection vehicle. The hydraulic lift 27 is preferably a pair of arms 28, which are rotatably mounted at one end to the waste collection vehicle for rotation about a first axis 29 and whose other end mounts to the intermediate size container 14. The end of the lift arms 28 mounting the intermediate size container include hydraulic actuators 30, which are adapted to rotate the intermediate size container about a second rotational axis 31.

Figure 2:
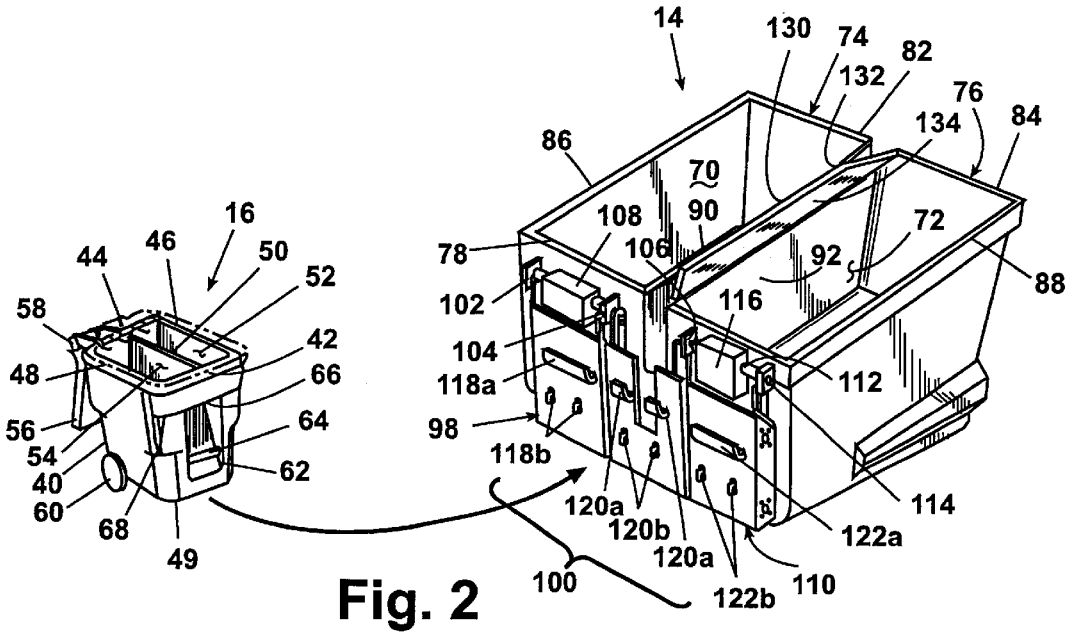
FIG. 2 is a perspective view of the divided cart and intermediate size container shown in FIG. 1 and illustrating the connection between the divided cart and intermediate size container.

Referring to FIG. 2, the divided cart 16 comprises a generally rectangular body 40 having a front wall 42, rear wall 44, opposing side walls 46 and 48 and bottom wall 49. A divider wall 50 extends between the front wall 42 and the rear wall 44 to divide the body 40 into first and second compartments 52 and 54.

A cover 56 is hingedly mounted to a handle 58, extending from the rear wall 44. The cover 56 is adapted to close the open top of the body 40. The rear wall 44, side walls 46, 48 and bottom wall 49 all define an inset portion in which a wheel and axle assembly 60 is provided to aid in moving the divided cart 16. The front wall 42 defines an inset portion 62 across which spans a grab handle 64. An upper handle 66 is formed at the junction of a lip 68 and the inset portion 62.

The intermediate size container 14 comprises a first compartment 70 and second compartment 72, which are defined by a pair of spaced containers 74 and 76. Each of the containers has a front wall 78, 80, rear wall 82, 84, exterior side walls 86, 88 and interior side walls 90, 92, which effectively define a dividing wall between the first and second compartments 70 and 72. The containers are connected at the lower portion of the interior dividing walls 90 and 92.

A lift mechanism 98 is provided on the front walls 78, 80 and comprises a first lifting plate 100, which has a portion that spans the divider wall between the first and second container 74 and 76. Spaced support arms 102, 104, and 106 pivotally mount the first lifting plate 100 to the intermediate size container 14 by pivotally mounting one end to the rear of the first lifting plate and the other end pivotally mounted to the front walls 78, 80. A hydraulic actuator 108 is mounted to the front wall 78 and to the first lifting plate 100 to rotate the first lifting plate 100 about the pivotal connection of the arms 102, 104, 106 to the front walls 78, 80.

Similarly, a second lifting plate 110 is pivotally mounted to the front wall 80 through spaced support arms 112 and 114. A hydraulic actuator 116 is adapted to rotate the second lifting plate 110 relative to the front walls 78 and 80.

Multiple saddles 118*a,* 120*a* and 122*a* are provided on the first and second lifting plates 100, 110 and are adapted to engage the upper handle 66 of the divided cart 16 to lift the cart as the lifting plates 100, 110 are raised. Multiple rotatable lower cart hooks 118*b,* 120*b,* 122*b,* corresponding to saddles 118*a,* 120*a,* 122*a,* respectively, are also disposed on the lifting plates 100 and 110. The lower cart hooks 118*b,* 120*b,* 122*b* rotate to engage the grab handle 64 of the cart to prevent the cart from sliding off the lift when the cart is in the inverted position.

The three saddles 118*a,* 120*a,* 122*a* provide additional functionality to the lift mechanism 98. The saddle 118 is positioned on the first lifting plate 100 so that both compartments 52 and 54 of the divided cart 16 will be aligned with the first compartment 70 of the intermediate size container 14. Similarly, the third saddle 122*a* is positioned on the second lift 110 so that the first and second compartments 52, 54 of the divided cart 16 will be aligned with the second compartment 72 of the intermediate size container 14. The saddle 120*a,* provided on the first lifting plate 10, is substantially in line with the divider wall of the intermediate size container 14 so that the first compartment 52 of the divided cart 16 is aligned with the first compartment 70 of the intermediate size container and the second compartment of the divided cart 16 is aligned with the second compartment of the intermediate size container 14. The several saddles provide for the dumping of the entire contents of the divided cart 16 into one of the compartments of the intermediate size container or segregating the contents of the divided cart 16 into the corresponding compartments of the intermediate size container. This increased functionality is very useful and advantageous in that not all users of the divided divided cart 16 separate their waste into recyclable and non-recyclable. Further, two undivided carts can be dumped simultaneously into the intermediate container 14 with the lift mechanism 98.

Figure 3:
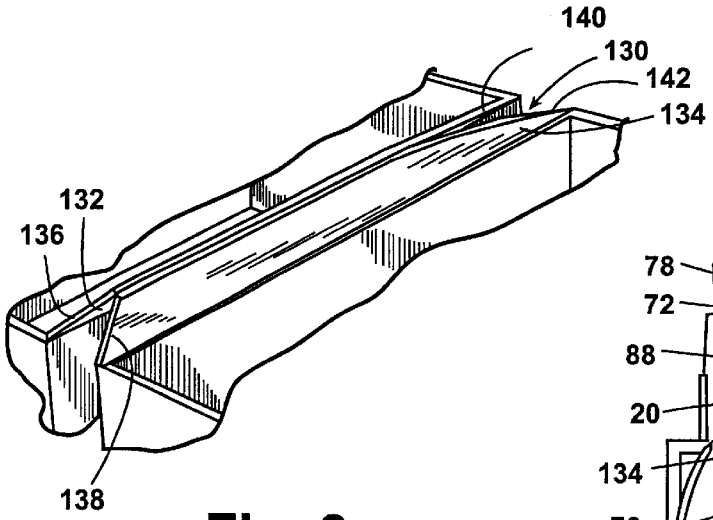
FIG. 3 is an enlarged view of the intermediate size container shown in FIG. 1 and illustrating the deflectors in a filling position.
Figure 4:
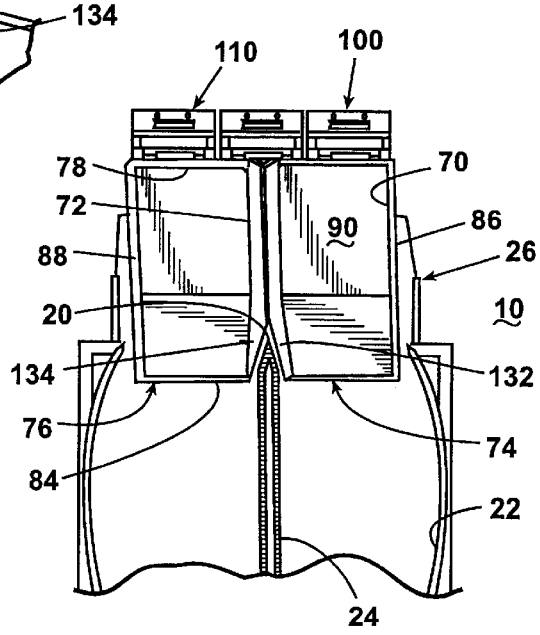
FIG. 4 is an enlarged partial view of FIG. 1 in the dumping position and the intermediate size container illustrating the interface between the deflector and the waste collecting vehicle.
Figure 5:
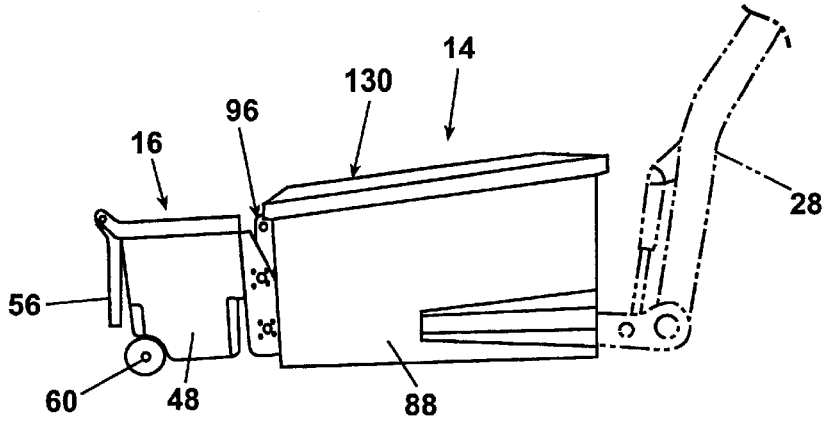
FIG. 5 is a side view of the divided cart shown in FIG. 1 connected to the intermediate size container with the divided cart in a loading position.
Figure 6:
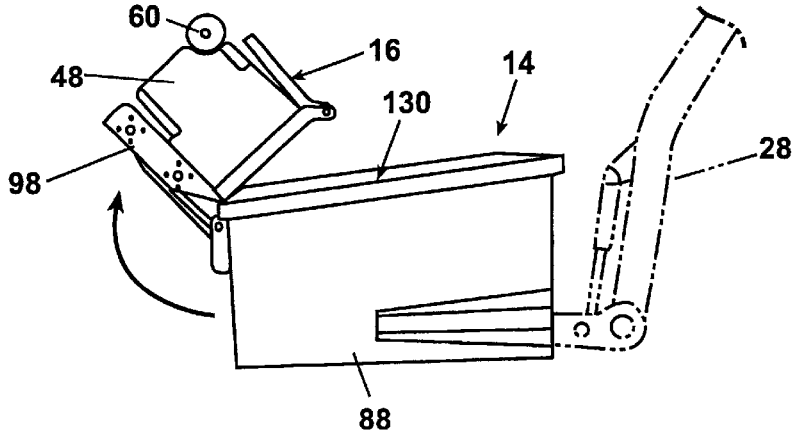
FIG. 6 is a view similar to FIG. 5 except that the divided cart is shown in the dumping position.
Figure 7:
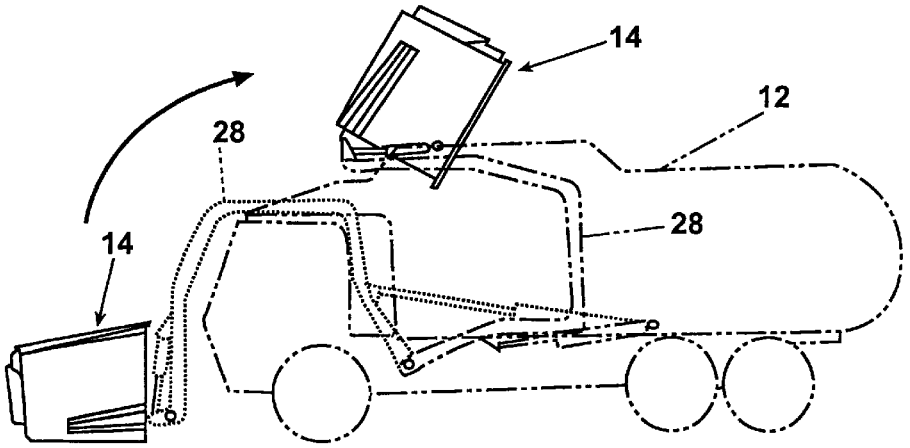
FIG. 7 is a schematic side view of the intermediate size container of FIG. 1 in a dumping position relative to the waste-receiving vehicle.

Referring to FIGS. 2–4, the intermediate size container 14 has a deflector assembly 130 comprising a pair of blades 132, 134. The blades 132, 134 have sharply angled leading edges 136, 138 and more gently angled trailing edges 140, 142. The trailing edges 140, 142 preferably have an increasing angle relative to the upper edge of the walls 90, 92. The increasing trailing edge angle defines a tapered opening between the trailing edges 140, 142 to aid in positioning the divider 20 of the storage container 18 between the blades 132, 134 when the intermediate size container 14 is in the dumping position (FIG. 7)

The blades 132, 134 are preferably made from a flexible material, such as high density polyethylene (HDPE) and the like. The blades 132, 134 are mounted to the upper edge of the walls 90, 92 by threaded bolts (not shown) passing through the blades 132, 134 and walls 90, 92, respectively, with nuts threaded on the end of the bolts. Any other suitable fastener can also be used, such as mechanical fasteners. Preferably, the blades 132, 134 are removably mounted for easy replacement.

In operation, a divided cart 16 containing, for example, recyclable material in one compartment and non-recyclable material in another compartment is moved to the leading position by wheeling the intermediate size container 14 mounted to the waste collection vehicle 12 with the intermediate size container in the fill position. The cover 56 is then opened and the divided cart 16 is placed on the lift mechanism 98 so that the cart hook 120*b* is received within the inset 62 and engages the grab handle 64. The lift mechanism 98 is then actuated so that the first lifting plate 100 pivots about the hinge connection between the support arms 102, 104, 106 and the front walls 78, 80 until the divided cart 16 is partially inverted (dumping position) and the divider wall 50 of the divided cart aligns with the peak of the deflector blades 132, 134. As the contents from the first compartment 52 and second compartment 54 of the divided cart 16 dump into the corresponding first compartment 70 and second compartment 72 of the intermediate size container 14, the deflectors will deflect any waste adjacent the divider wall of the container cart into the appropriate compartment of the intermediate size container 14. This process is repeated for multiple divided carts until the intermediate size container 14 is full or it is desired to dump the contents of the intermediate size container into the waste collection vehicle 12.

Although only the description of a divided cart containing segregated waste has been described, the process for dumping a divided cart with both compartments filled with a single type of waste is similar to that described above except that the divided cart is mounted to the cart hook 118*b* or 120*b* as appropriate.

To dump the contents of the intermediate size container 14 into the waste collection vehicle 12, the hydraulic lift 26 of the waste collection vehicle 12 is actuated so that the arms 28 are rotated about rotational axis 29 and the divided cart is lifted towards the hopper 27 and partially inverted. As the intermediate size container 14 is moved to a partially inverted position (the dumping position), the divider wall 20 is received between the trailing edges 140, 142 of the blades 132, 134, effectively sealing the divider wall of the intermediate size container 14 relative to the divider wall 20 of the storage container 18. The tapered opening defined by the trailing edges of the blades helps to ensure the divider wall 20 is received between the blades because the intermediate size container 14 is often jostled side-to-side in response to the non-steady movement of the arms 28.

Typically, the divider wall 20 is knife-edged so that as it is received in the tapered opening between the blades 132, 134, the divider wall deflects the blades to a greater distance as the intermediate size container is inverted. The divider wall 20 effectively "un-zips" the blades, with each blade being positioned on an opposite side of the divider wall 20 to function as a seal between and deflector for the aligned compartments 70, 22 and 72, 24 of the intermediate size container and storage container. Because the blades 132, 134 are resilient, the blades 132, 134 are resiliently spread as the divider wall is forced in-between the blades 132, 134.

In the partially inverted position (dumping position), the first and second compartments, 70, 72 of the intermediate size container 14 are aligned with the first and second compartments 22, 24 of the waste storage container 18, respectively, and the contents of the intermediate size container compartments dump into the aligned compartments of the waste storage container 18. The hydraulic actuators 30 are then actuated to further invert the intermediate size container 14 to ensure complete transfer of the contents from the intermediate size container 14 into the waste storage container 18.

After the contents of the intermediate size container 14 have been dumped into the waste storage container 18, the intermediate size container 14 is lowered back toward the ground by reversing the direction of rotation of the lift arms 28 of the hydraulic lift 26. As the intermediate size container 14 is lowered, the blades 132, 134 flex back to their original position in which they form a triangular deflector for the divided cart 16.

An advantage of the segregated waste collection system according to the invention is that the design and operation of the divided cart 16 is simplified with a single cover, especially when the divided cart 16 has more than two compartments.

Figure 8:
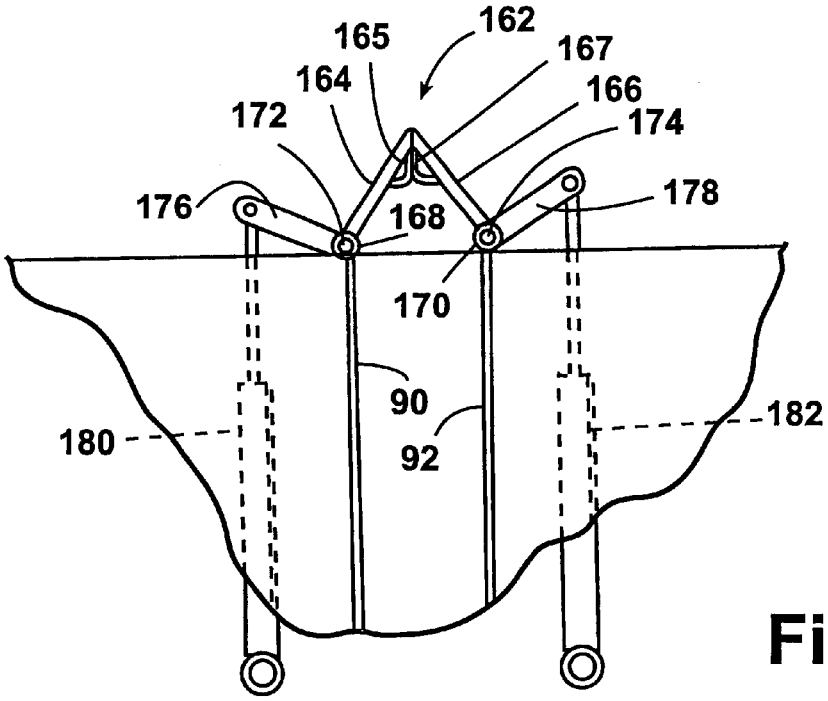
FIG. 8 is a partial front elevational view of the intermediate size container, illustrating a second embodiment of the invention with deflectors shown in the filling position.

FIG. 8 illustrates an alternative embodiment of the invention wherein like numerals will be used to identify like parts. Alternative deflectors 162 comprise opposed deflector plates 164, 166 each of which have longitudinal supports 165, 167 and are pivotally mounted to interior side walls 90, 92 by hinges 168, 170, respectively. Deflector plate 166 is rigidly mounted to a lever arm 178 through a hinge pin 174. Likewise, deflector plate 164 is rigidly mounted to lever arm 176 through a hinge pin 172. The hinge pins 172, 174 are pivotally mounted in sockets in the hinges 168 and 170 for pivotal movement of the deflector plates 164, 166 with respect to the walls 90, 92. The lever arms 176, 178 are mounted at other end to actuators 180, 182, respectively. The actuators 180, 182 are preferably pneumatic actuators, although any suitable type of actuator can be used.

Figure 9:
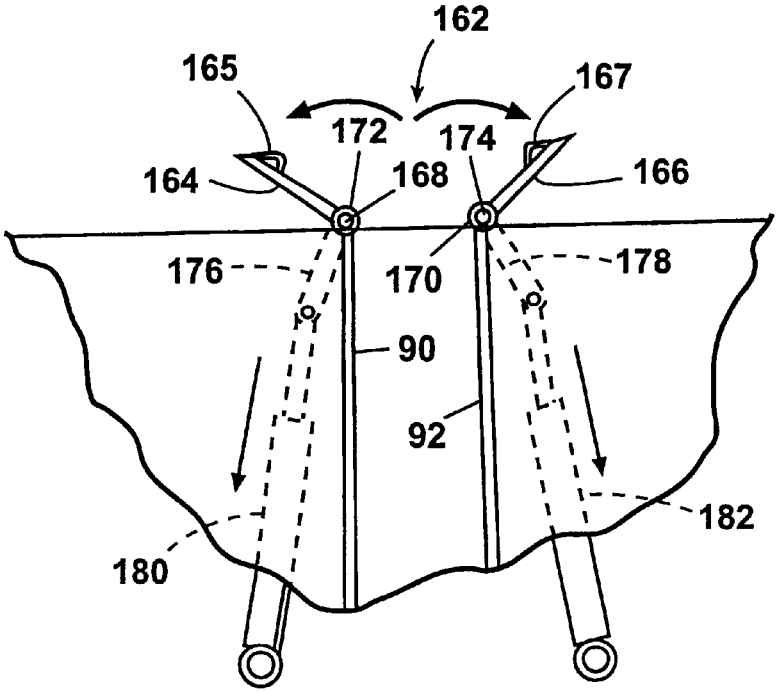
FIG. 9 is a view, like FIG. 8, of the intermediate size container and illustrating the deflectors in a dumping position.

The actuators 180, 182 rotate the lever arms 176, 178 to move the deflector plates 164, 166 from their filling position (FIG. 8), in which their upper ends meet to form an inverted V-shaped deflector, to an dumping position (FIG. 9), in which the deflectors 162, 164 are rotated away from each other.

The operation of the segregated waste collection system using the alternative deflectors is substantially identical to the operation of the segregated waste collection system as described above with respect to FIGS. 1–7. The only difference is that as the intermediate size container is moved from the fill position to the dumping position, the deflector plats 164, 166 must be moved from fill position (FIG. 8) to dumping position (FIG. 9) by actuation of the actuators 180, 182. The actuators are preferably actuated by a proximity switch (not shown) encountered by the lift arms 28 as they are rotated. However, any suitable mechanism can be used to automatically or manually operate the actuators 180, 182.

Figure 10:
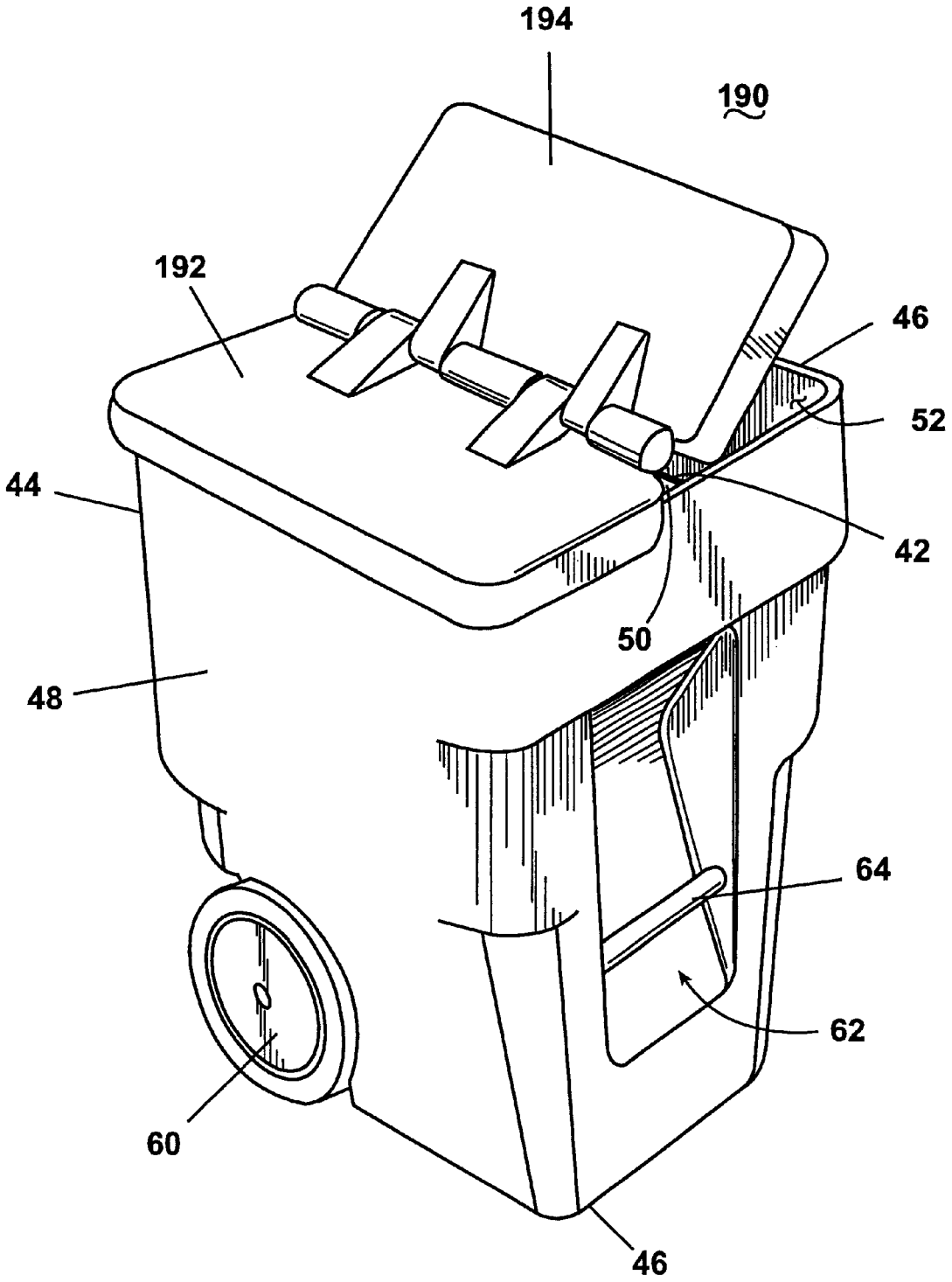
FIG. 10 is a perspective view of a divided cart illustrating an alternative embodiment of the invention.
Figure 11:
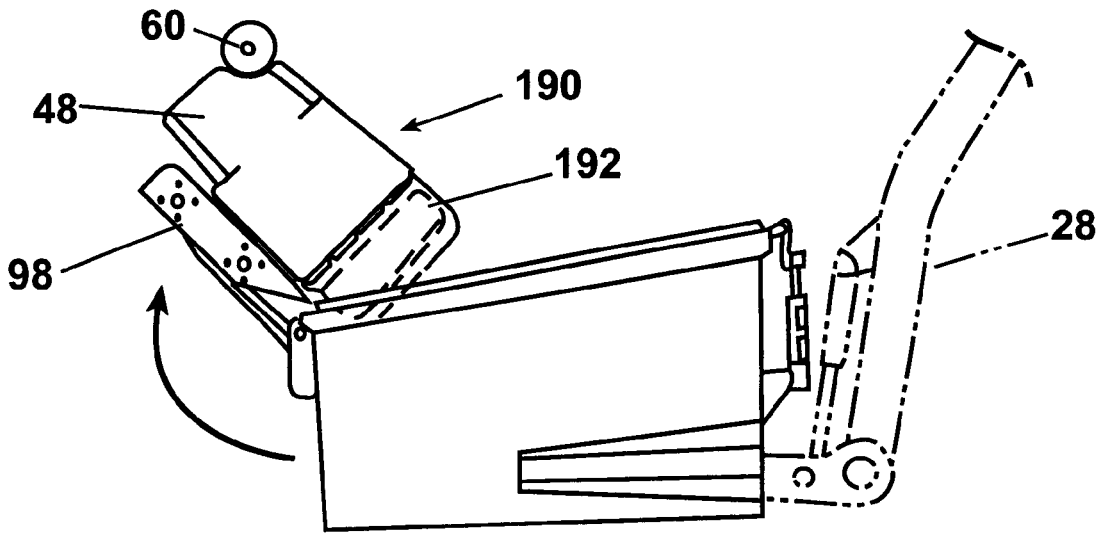
FIG. 11 is a schematic side elevational view of the divided cart of FIG. 10 mounted to the intermediate size container in the dumping position.

FIGS. 10 and 11 illustrate a second embodiment of the divided cart 16. Like numbers will be used to identify like numbers of the segregated waste collection system 10 when describing the alternative cart 190. The alternative cart 190 is substantially identical to the divided cart 16 except that the single cover 56 of the divided cart 16 is replaced by multiple covers 192, 194 corresponding to each of the compartments 52 and 54. The covers 192 and 194 are hingedly mounted to the divider wall 50.

The operation of the segregated waste collection system with the alternative cart 190 is substantially identical to the segregated waste collection system as described above with respect to FIGS. 1–7, except that the covers 192 and 194 are not opened prior to lifting the cart 190. Instead, the covers 192 and 194 remained closed as the cart 190 is lifted to the partially inverted position. As the cart 190 moves to the partially inverted position, the covers 192 and 194 will rotate to open under the force of gravity and lie against the deflectors on the intermediate size container 14 as best illustrated in FIG. 11. When the cart is in the partially inverted position, the covers 192 and 194 supplement the deflective function of the deflectors.

While particular embodiments of the invention have been shown, it will be understood that the invention is not limited thereto since modifications may be made by those skilled in the art, particularly in light of the foregoing teachings. Reasonable variation and modification are possible within the scope of the foregoing disclosure and drawings without departing from the spirit of the invention.

We claim:

1. A segregated waste collection system for collecting segregated waste from a distant location and moving the collected segregated waste to a centralized collection station while maintaining the segregated state of the waste, the segregated waste collection system comprising:

a waste container for use at the distant location and comprising a bottom wall from which extends a peripheral wall to define a waste receiving chamber and a divider disposed within the waste receiving chamber to divide the waste receiving chamber into two waste compartments, each waste compartment is capable of receiving different types of waste to thereby segregate the waste;

a transfer container comprising a base from which extends a peripheral wall to define a transfer chamber and a divider disposed within the transfer chamber to divide the transfer chamber into two transfer compartments, each of the transfer compartments corresponds to a different one of the two waste compartments in the waste container;

a collection vehicle comprising a storage container and a divider disposed within the storage container to divide the storage container into two storage compartments, each of the storage compartments corresponding to one of two transfer compartments, and a loading mechanism carrying the transfer container and operable between a transfer position, in which the transfer container is positioned to receive the contents of the waste container, and a dumping position, in which the transfer container is positioned to dump its contents into the storage container; and a deflector on the transfer container, aligned with the transfer container divider and operable between a fill position to deflect the waste container contents from the waste compartments into the corresponding transfer compartments when the waste container is at least partially inverted over the transfer container and the transfer container is in the transfer position and a dump position to deflect the contents from the transfer compartments into the corresponding storage compartments when the transfer container is in the dumping position to thereby maintain the segregated status of the waste from the waste container to the storage container.

2. A segregated waste collection system according to claim 1 wherein the deflector comprises a pair of opposing vanes.

3. A segregated waste collection system according to claim 2 wherein the vanes have a wedge-shaped profile that converges as the vanes extend away from the transfer container.

4. A segregated waste collection system according to claim 2 wherein each vane has an inner edge and an outer edge, the inner edges extend along the transfer container divider, and the outer edges are spaced above the transfer container divider.

5. A segregated waste collection system according to claim 4 wherein the outer edges are spaced with respect to each other to define a gap that receives the at least one container divider when the transfer container is in the transfer position and the storage container divider when the transfer container is in the dumping position.

6. A segregated waste collection system according to claim 4 wherein the vanes are pivotally mounted at the inner edges thereof to the transfer container for pivotal movement between a fill position in which the outer edges substantially abut each other and a dump position in which the outer edges are spaced from each other and each outer edge partially overlies a different transfer compartment, wherein the vanes are in the fill position when the transfer container is in the transfer position and the vanes are in the dump position when the transfer container is in the dumping position.

7. A segregated waste collection system according to claim 6, and further comprising a pair of hinges, each hinge mounted to the transfer container divider wall, and each vane is mounted at inner edge to one of the hinges to pivotally mount the vanes to transfer container.

8. A segregated waste collection system according to claim 7 and further comprising a pair of actuators, each actuator is connected between the transfer container and one of the vanes to pivot the vanes between the fill and dump positions.

9. A segregated waste collection system according to claim 1 and further comprising a lift mounted to the transfer container for lifting the waster container into a transfer container filling position relative to the transfer container.

10. A segregated waste collection system according to claim 9 wherein the lift comprises an index for positioning the waste container on the lift so that when the waste container is in the transfer container filling position, the waste container compartments are aligned with the corresponding transfer container compartments.

11. A segregated waste collection system according to claim 10 wherein the transfer container is removably carried by the loading mechanism.

12. A segregated waste collection system according to claim 10 wherein the waste container has a pair of lids pivotally mounted to the waste container and each lid overlies a portion of the deflector to form at least a partial barrier between the waste container divider and the transfer container divider when the waste container is at least partially inverted over the transfer container.

13. A segregated waste collection system for collecting segregated waste from a distant location and moving the collected segregated waste to a centralized collection station while maintaining the segregated state of the waste, the segregated waste collection system comprising:

a transfer container comprising a base from which extends a peripheral wall to define a transfer chamber and a divider disposed within the transfer chamber to divide the transfer chamber into two transfer compartments;

a collection vehicle comprising a storage container and a divider disposed within the storage container to divide the storage container into two storage compartments, each storage compartment corresponding to a different one of the two transfer compartments, and a loading mechanism carrying the transfer container and operable between a receiving position, in which the transfer container is positioned to receive waste material, and a dumping position, in which the transfer container is positioned to dump its contents into the storage container; and a deflector on the transfer container, aligned with the transfer container divider and operable between a fill position in which the deflector is positioned to guide the waste into the appropriate transfer compartment when the transfer container is in the transfer position and a dump position in which the deflector is positioned to guide the contents from the transfer compartments into the corresponding storage compartments when the transfer container is in the dumping position to thereby maintain the segregated status of the waste from the waste container to the storage container.

14. A segregated waste collection system according to claim 13 wherein the deflector comprises a pair of opposing vanes each having a inner edge and an outer edge, the vanes being pivotally mounted at the inner edges thereof to the transfer container and pivotally move between a fill position in which the outer edges substantially abut each other and a dump position in which the outer edges are spaced from each other and each outer edge partially overlies a different transfer compartment, wherein the vanes are in the fill position when the transfer container is in the transfer position and the vanes are in the dump position when the transfer container is in the dumping position.

15. A segregated waste collection system according to claim 14 and further comprising a pair of hinges, each hinge mounted to the transfer container divider, and each vane mounted at an inner edge to one of the hinges to pivotally mount the vanes to transfer container.

16. A segregated waste collection system according to claim 15 and further comprising a pair of actuators, each actuator is connected between the transfer container and one of the vanes to pivot the vanes between the fill and dump positions.

17. A segregated waste collection system according to claim 13 wherein the transfer container is removably carried by the loading mechanism.

18. A transfer container for a segregated waste collection system comprising a waste container located at a distant location, a collection vehicle for moving the collected segregated waste to a centralized collection station, and the transfer container transferring the waste from the waste container to the collection vehicle while maintaining the segregated state of the waste, the waste container comprises a bottom wall from which extends a peripheral wall to define a waste receiving chamber and a divider disposed within the waste receiving chamber to divide the waste receiving chamber into two waste compartments, each waste compartment is adapted to receive different types of waste to thereby segregate the waste, the collection vehicle comprises a storage container and a divider disposed within the storage container to divide the storage container into two storage compartments, each storage compartment corresponding to a different one of the two transfer compartments, and a loading mechanism for carrying the transfer container and operable between a transfer position, in which the transfer container is positioned to receive the contents of the waste container, and a dumping position, in which the transfer container is positioned to dump its contents into the storage container, the transfer container comprises:

a base from which extends a peripheral wall to define a transfer chamber and a divider disposed within the transfer chamber to divide the transfer chamber into two transfer compartments, each of the transfer compartments corresponding to a different one of the two waste compartments; and a deflector mounted on the transfer container divider and operable between a fill position in which the deflector is positioned to guide waste from the waste container compartment to the corresponding transfer compartment when the transfer container is in the transfer position and a dump position in which the deflector is positioned to guide the contents from the transfer compartments into the corresponding storage compartments when the transfer container is in the dumping position to thereby maintain the segregated status of the waste from the waste container to the storage container.

19. A transfer container according to claim 18 wherein the deflector comprises a pair of opposing vanes.

20. A transfer container according to claim 19 wherein each vane has an inner edge and an outer edge, the inner edges extend along the transfer container divider, and the outer edges are spaced above the transfer container divider.

21. A transfer container according to claim 20 wherein the vanes are pivotally mounted to the inner edges thereof to the transfer container for pivotal movement between a fill position in which the outer edges substantially abut each other and an dump position in which the outer edges are spaced from each other and each outer edge partially overlies a different transfer compartment, wherein the vanes are in the fill position when the transfer container is in the transfer position and the vanes are in the dump position when the transfer container is in the dumping position.

22. A transfer container according to claim 21 and further comprising a pair of hinges, each hinge mounted to the transfer container divider wall, and each vane mounted on an inner edge to one of the hinges to pivotally mount the vanes to transfer container.

23. A transfer container according to claim 22 and further comprising a pair of actuators, each actuator is connected between the transfer container and one of the vanes to pivot the vanes between the fill and dump positions.

* * * * *

UNITED STATES PATENT AND TRADEMARK OFFICE

CERTIFICATE OF CORRECTION

PATENT NO. : 6,325,587 B1
DATED : December 4, 2001
INVENTOR(S) : Edward H. Wysocki It is certified that error appears in the above-identified patent and that said Letters Patent is hereby corrected as shown below:

Title page,
Item [75], Inventors, "Edward H. Wysocki, Kentwood, MI (US); Jimmy O. Bayne, Anderson, SC (US)." should be -- Edward H. Wysocki, Kentwood, MI (US). --

Signed and Sealed this

Thirteenth Day of August, 2002

*Attest:*

*Attesting Officer*

JAMES E. ROGAN
*Director of the United States Patent and Trademark Office*